US005865337A

United States Patent [19]

Diamond et al.

[11] Patent Number: 5,865,337

[45] Date of Patent: Feb. 2, 1999

[54] THIN WALLED COVER FOR AEROSOL CONTAINER AND METHOD OF MAKING SAME

[75] Inventors: George B. Diamond, Glen Gardner; Ralph Helmrich, Asbury, both of N.J.; Gerlad P. Hawkins, Denver, Colo.

[73] Assignee: Dispensing Containers Corporation, Glen Gardner, N.J.

[21] Appl. No.: 882,962

[22] Filed: Jun. 26, 1997

Related U.S. Application Data

[63] Continuation of Ser. No. 507,045, Jul. 25, 1995, Pat. No. 5,704,513.

[51] Int. Cl.[6] ..... B65D 8/06

[52] U.S. Cl. ..... 220/619; 220/658

[58] Field of Search ..... 220/619, 618, 220/615, 658

[56] References Cited

U.S. PATENT DOCUMENTS

| | | | |
|---|---|---|---|
| 2,643,914 | 6/1953 | Reswick | 220/619 |
| 2,715,481 | 8/1955 | McGhie et al. | 220/619 |
| 2,795,350 | 6/1957 | Lapin | 220/619 |
| 4,775,071 | 10/1988 | Giggard | 220/619 |

*Primary Examiner*—Joseph M. Moy
*Attorney, Agent, or Firm*—Ostrolenk, Faber, Gerb & Soffen, LLP

[57] ABSTRACT

A top cover for an aerosol container comprises a seamable cover which is relatively thin walled with an outer periphery adapted for attachment to an aerosol container body, and a central opening defined by an inner periphery, the cover has a generally rounded dome shaped and the seamable cover is free of a countersunk recess in the vicinity of the periphery.

3 Claims, 6 Drawing Sheets

FIG. 1.
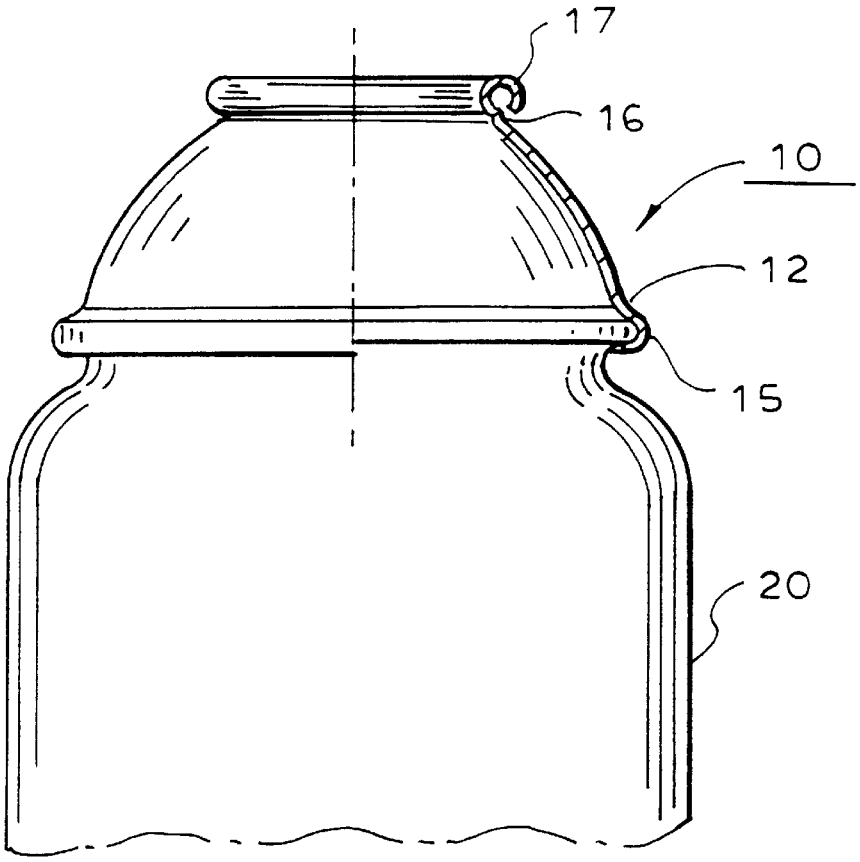
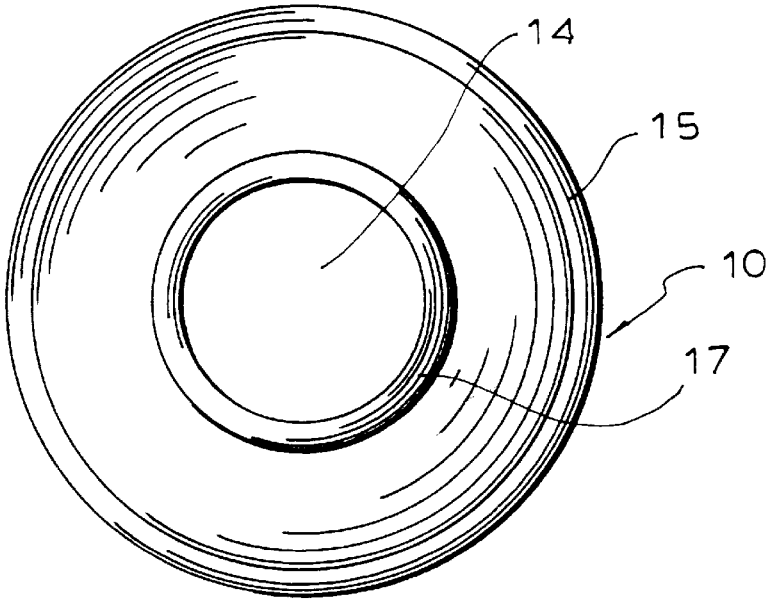
FIG. 2.

THIN WALLED COVER FOR AEROSOL CONTAINER AND METHOD OF MAKING SAME

This is a continuation of application Ser. No. 08/507,045 filed Jul. 25, 1995 now U.S. Pat. No. 5,704,513.

BACKGROUND OF THE INVENTION

The present invention relates to the cover of an aerosol spray container, either of the barrier or non-barrier type, and particularly relates to a cover of an aerosol container that is thin walled.

Aerosol spray containers have been used worldwide for decades. Typically, these containers are made of metal, such as steel or aluminum, and dispense either fluent materials or viscous materials and are either of the non-barrier type or the barrier type. Many fluent materials, and particularly those of lower viscosities, are dispensed from pressurized aerosol containers of the non-barrier type, wherein there is no separation between the fluent material to be dispensed and the pressurizing propellant within the container. In contrast, a barrier type dispensing container has a movable barrier within the container, such as a flexible diaphragm or a piston, where the material to be dispensed is at the side of the barrier towards the outlet and the propellant is on the other side of the barrier and pushes against the barrier and thereby forces the fluent materials of higher viscosities through the container dispenser valve.

The aerosol container comprises a generally cylindrically shaped container body having an open end with a cover attached to the open end usually by seaming or crimping, although welding or gluing is sometimes used. A spray, foam or stream nozzle is supported in the cover and communicates with the contents in the container body for dispensing the contents through the nozzle when the nozzle is activated.

Characteristic to the cover of most aerosol containers is a countersunk recess that projects into the container body and extends circumferentially in the radial vicinity of where the cover joins the container body. Radially inward of the recess the cover has a rounded, generally convex dome. The countersunk recess is for receiving a seaming chuck used in the process of joining the cover to the container body. However, the recess is the weakest and therefore most easily deformed part of the cover when the aerosol container is pressurized. Therefore, aerosol container covers have to be relatively thick walled to protect against the cover being deformed under pressure. The weakness at the recess in the cover is particularly critical when the pressure in the aerosol container increases due to ambient temperature increases during storage, transportation or manufacture.

Covers may also have a small ridge inwardly from the recess for the purpose of holding a cover cap.

The typical procedure for joining the cover to the container body involves a double seaming process. The container body is formed with a flange along the outer edge of the open end, and the cover is formed with a curl along its outer edge and a recess in the vicinity of the curled edge.

In the first seaming operation, the curl of the cover is interlocked with the flange at the top of the container body. The container body is positioned on a base plate, which may be rotatable, and the seaming chuck is positioned within the countersunk recess of the cover. The cover and the container body are interlocked by a seaming roller having a specially contoured groove. The seaming roller engages the curl of the cover and the flange of the container body and interlocks them by compressing them against the opposing resistance of the seaming chuck. During this first seaming operation, the cover and container body are rotated past the seaming roller by rotation of either the base plate or the chuck, or by both. A good quality first operation seam is neither too loose nor too tight and the flange of the container body is well tucked down in the radius of the curl of the cover. After the first seaming operation, the first seaming roller is retracted and no longer contacts the cover or the container body.

For the second seaming operation, a second seaming roller is used having a second groove profile different from that of the first seaming roller. The second groove profile is flatter than the profile of the first seaming roller and the groove profile is designed to press the curl of the cover and the flange of the container body tightly together to develop double seam tightness. Also during this step, sealing compound, if previously applied to the cover or otherwise used, is distributed evenly around the seam. After the double seaming operation is completed, the recess remains as part of the profile of the cover and does not change in form or shape even after the aerosol container is filled with a fluent material and pressurized.

The internal container pressure to which the cover is subjected and especially at its weakest region at the countersunk recess, has required that the cover wall be made relatively thick so that it does not permanently distort, evert or rupture from the high pressure encountered during filling, storage, transportation, use and testing. It is not unusual that during storage and transportation, the aerosol container is exposed to elevated ambient temperatures which elevate the internal pressure of the container, and this further stresses the recess in the cover.

Because of the potential dangers of rupture or distortion of an aerosol container, several government agencies have required that certain types of aerosol containers have particular strengths or distortion and burst resistances.

For example, a United States Department of Transportation regulation requires that an aerosol container having less than 27.7 fluid ounces or 819.2 ml capacity be able to withstand and not permanently distort at an internal pressure equal to the equilibrium pressure of its intended contents, including fluent material and propellant at 130° F. or 54.4° C. (122° F. or 50° C. is also a standard being adopted), and that the pressure in the container must not exceed 140 psig or 965 kPa or 9.65 bar, at 130° F. or 54.4° C. If the internal pressure in the aerosol container exceeds 140 psig or 965 kPa or 9.65 bar, special specifications for the can are required. Moreover, the U.S. Department of Transportation also requires that there be no permanent distortion of the aerosol container at 130° F. or 54.4° C. and that the container not burst at a pressure that is one and one half times as great as the pressure at 130° F. or 54.4° C. Thus, for example, if the equilibrium pressure of the aerosol container at 130° F. or 54.4° C. is 140 psig or 965 kPa or 9.65 bar, then the container should not burst at 210 psig or 1448 kPa or 14.48 bar.

In order to meet government mandated regulations and to withstand expected elevated internal pressure, the cover of a conventional aerosol container made of steel has a wall thickness in the range of 0.012 to 0.013 inch or 0.305 to 0.330 mm, while the wall thickness of a cover made of aluminum, depending on the alloy, is in the range of 0.012 to 0.018 inch or 0.305 to 0.457 mm. These requirements in the wall thickness of the cover produce a cover that weighs 16 to 20 grams if it is made of steel and has a diameter of approximately 2.47 inches, or a weight of 14.7 grams if it is made of an aluminum alloy and has a diameter of 2.47 inches and a wall thickness of about 0.016 inch or 0.406 mm.

If it were not for the inherent weakness of the chuck recess region in the aerosol container cover, covers could be made from a thinner walled metal producing substantial advantages both economically and environmentally. However, conventional wisdom is not to fabricate the covers of thinner walled metal, but rather to use thicker walled metal. The economic and environmental drawbacks of relatively thick walled aerosol container covers are great considering that approximately 10 billion aerosol containers are used yearly world-wide. From an economic standpoint, it is readily understood that a reduction in the thickness of the aerosol container cover can have a significant impact in reducing the need for ores and minerals used in producing these covers, particularly as these ores and minerals are in diminishing supply. With the cost of steel now at about U.S. $600 to $700 U.S. per ton, an aerosol container cover having half the conventional wall thickness results in a savings of about one half the steel required, or a savings of over $18 million per year for all U.S. consumers. Comparable or even greater savings are also achievable using aluminum covers. The average weight of a conventional thick walled cover, having a diameter of about 2½ inches, or about 1 cm, is about 0.7 oz. (20 grams). If the wall thickness of the cover were reduced by half, a savings of 10 grams per cover or 30 billion grams (30 thousand tons) of steel would be achieved in the U.S. alone, and a savings of about 100 thousand tons of steel would be achieved worldwide. Comparable savings could result for aluminum covers.

In addition, more energy is consumed in obtaining the metal ore, in producing the metal, and in manufacturing aerosol container covers having relatively thick walls. The cost of transporting the metal for these covers at every stage from initial ore production, to transporting the metal for making the covers, to transporting the filled cans must also be considered. If the covers were of a thinner walled metal and were therefore lighter in weight, substantial savings in transportation costs would result. At approximately 30 tons per truck load, this translates to a thousand trucks per year for each stage of shipment. With three or four stages of shipment, this produces a very large saving in the cost of truck shipments.

Needless to say, each of the above economic factors also has an environmental impact. Adverse effects could be significantly reduced if the cover of the aerosol container could be reduced in wall thickness and still meet the stringent safety requirements mandated by various governments. In addition, the relatively thick walled cover of conventional aerosol containers are stiff and thus not easily deformed or crushed for enabling disposal or recycling.

Since countersunk recesses in container covers are traps for dust and dirt, a further advantage to be gained by eliminating these recesses is to provide a more sanitary container or one with easier access to exposed surfaces of the cover for cleaning them. Moreover, one method by which the industry combats the unsanitariness problem is to use a large shoulder overcap to prevent dust and dirt from accumulating within the countersunk recess. However, such overcaps add unnecessary cost to an aerosol container and pose additional environmental pollution problems. Thus, if the source of the problem, the recess, is eliminated, large shoulder overcaps are not necessary.

SUMMARY OF THE INVENTION

A primary object of the present invention is to provide a cover for an aerosol container that does not have a countersunk recess, and to thereby eliminate the inherent weakness attributable to this recess when the container is pressurized.

A further object of the invention is to provide an aerosol container cover having a thinner wall, 10% to 70% thinner, than that found in conventional container covers.

Another object of the invention is to provide a cover for an aerosol container having a thin wall, which will not deform or rupture under the pressure encountered in manufacturing, transportation, storage, use and testing of the aerosol container.

Yet another object is to provide a cover for aerosol containers that is thin walled but that can withstand internal pressures equal to or beyond those required by government safety regulations.

Still a further object is to provide a thinner walled aerosol spray can cover that satisfies various environmental concerns particularly by reducing the amount of metal needed to produce the cover by 10% to 70% as compared to conventional covers.

The present invention concerns reducing the wall thickness of the aerosol container cover and therefore is contrary to the conventional wisdom of those working in the design and manufacture of aerosol containers. A factor relevant to the cover of the present invention being of a thin walled material and still meeting government mandated regulations is the elimination in the cover of the countersunk recess, conventionally needed in the seaming process to accommodate a seaming chuck. The aerosol container cover of the present invention is, in cross-section, a generally continuous convex dome configuration as it extends from an outer periphery to an inner periphery, although it may be relatively flat just above the double seam. In general, the cover of the present invention is hemispherical, parabolic or elliptical in shape. By the physical nature of its configuration, which takes into account the elimination of the countersunk recess, the aerosol container cover of the present invention is capable of withstanding substantial pressure without deforming or rupturing.

The aerosol container cover of the present invention is of such a thin wall thickness that distortion or eversion of the cover would be expected at a pressure substantially lower than government mandated minimum distortion and/or eversion pressures. For example, according to regulations mandated by the United States government, an aerosol container cover must be of sufficient strength to withstand distortion at a pressure of at least 140 psig, while the European Union requires that aerosol container covers must not evert at pressures above 176 psig. However, the aerosol container cover of the present invention is of such a thin wall thickness that it would distort or evert at, for example, 110 psig below a government mandated minimum level for distortion or eversion. Thus, the aerosol container cover of the present invention is counter to conventional wisdom because of its thin wall construction. However, the cover of the present invention was already everted during its fabrication and before it is installed on a container. It thereby acquired a geometrical configuration that renders it resistive to any further distortion, eversion or rupture even at pressures substantially higher than government mandated minimum distortion and/or eversion pressures.

In addition, since the completed aerosol container cover of the present invention is free, or substantially free of any countersunk recess in the vicinity of its outer periphery, it lacks the narrow width recesses which can be troublesome in other covers where they may pose a sanitary problem since such recesses are collecting points for dust, dirt and like debris and are not easily entered or cleaned out.

There are several methods by which the cover of the present invention can be manufactured, and the method by which it is manufactured determines the method by which the cover is attached to an aerosol container body. In a first method, the aerosol container cover is formed and shaped by a standard stamping process and initially includes a countersunk recess for accommodating a seaming chuck, but is of a thinner wall thickness than the conventional aerosol container cover. A thin walled cover of such a configuration is totally contrary to the general design of aerosol covers, since the countersunk recess in the cover is especially vulnerable to deformation.

By standard processing, this thin walled cover is attached to a container body, such as by the double seaming process. Thereafter, a seal is placed either within or around the central opening of the cover with a tube extending through the seal. Under a controlled environment, a pressurized gas is dispensed into the aerosol container through the tube and the pressure is raised internally in the container to cause the countersunk recess to deform upwardly, i.e. evert, until it is substantially or completely eliminated from the container cover. The cover of the invention develops a generally convex dome configuration which is capable of withstanding substantial internal pressures to which the aerosol container may be subjected, even though the cover is of a thin wall thickness. Instead of using gas pressure, hydraulic pressure can be used or a mechanical system can be used to evert the cover. Only after the cover has been initially formed, installed on the container and everted is the container with cover ready for filling.

In an alternative method, the container cover of the present invention is formed in a conventional stamping machine to its generally convex dome configuration so that it lacks a countersunk recess. Again, the cover is everted before the container is filled and here even before the cover is placed on the container.

Since there is no countersunk recess in the cover of the present invention, unique apparatus and processing steps are employed to attach the container cover to a container body. In that process, the container body is placed on a base plate and the container cover is positioned at the open end of the container body so that the curl at the outer periphery of the cover mates with the flange at the open end of the container body. At least one, and preferably two distendable arms having rollers are inserted into the interior section of the container body through the central opening of the container cover. The distendable arms are then distended so that the rollers are positioned adjacent to the flange of the container body and the curl of the container cover. When seaming rollers are next brought into contact with the mating edges of the container body and container cover, the curl of the cover and the flange of the container body are sandwiched between the rollers of the distendable arms and the seaming rollers to form a seam therebetween. In forming the seam, the rollers of the distendable arms oppose the pressure of the seaming rollers. Either the base plate on which the container body rests or a rotating collar which abuts the cover and does not oppose the seaming roller force, or both the base plate and rollers, may rotate the container body and cover in synchronization with the seaming rollers, to form an even seam about the container. Instead of the container body and cover rotating, the seaming rollers and distendable arm rollers can rotate synchronously about the container body and cover.

Although only one rotatable distendable arm is required to perform the seaming process, this arm must be rotatable to oppose both seaming rollers in sequence. A second arm, positioned approximately 180 degrees from the first arm is preferred since this configuration does not require rotation of either arm within the container body.

Other features and advantages of the present invention will become apparent from the following description of the invention which refers to the accompanying drawings.

BRIEF DESCRIPTION OF THE DRAWINGS

FIG. 1 is a side view, partially in cross section, of an aerosol container cover of the present invention.

FIG. 2 is a plan view of the aerosol container cover of FIG. 1.

FIG. 11A is an alternative embodiment of a rotating collar shown in FIGS. 8, 9 and 11.

DETAILED DESCRIPTION OF THE INVENTION

Figure 3:
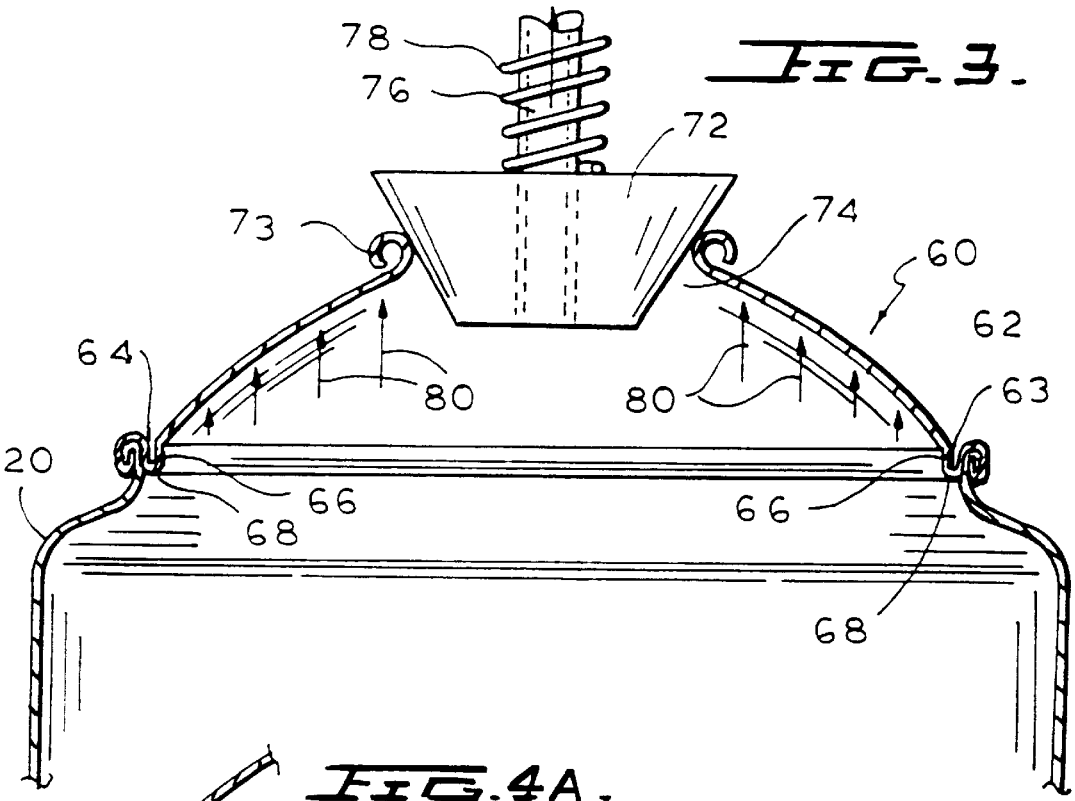
FIGS. 3 and 4 are cross-sectional, side views showing a first method for forming the aerosol container cover of the present invention.

Referring to FIGS. 1 and 2, the aerosol container cover 10 of the present invention has a generally convex dome shaped configuration. It is formed of a relatively thin walled coated or uncoated metal, plastic, or metal-plastic sandwich. Cover 10 has an outer periphery 12 with a curl 15 formed along its edge for enabling attachment to an aerosol container body 20, shown in phantom in FIG. 1. Cover 10 also includes a central opening 14 defined by an inner periphery 16 with a curled edge 17 for attachment of an aerosol nozzle. As the cover 10 extends from the outer periphery 12 to the inner periphery 16, it is generally rounded and of a generally hemispherical, parabolic, or elliptical shape. The configuration of the cover 10 enables it to withstand significant pressure from within the aerosol container 20 even though cover 10 is relatively thin walled. In fact, cover 10 can withstand distortion at container pressures above those which would normally rupture an aerosol container seam, i.e., above 300 psig (2068 kPa, or 20.7 bar).

Cover 10 is typically formed of a thin walled metal, such as steel or an aluminum alloy. If the cover 10 is made of steel, its wall thickness is in the range of 0.005 to 0.013 inch, (0.127 to 0.330 mm) with its diameter in the range of 1.77 to 3.00 inches (45 to 76.2 mm) and its weight in the range of 4 to 21 grams. If the cover is made of an aluminum alloy, its wall thickness is in the range of 0.005 to 0.018 inch (0.127 to 0.457 mm), with its diameter in the range of 1.77 to 3.00 inches (45 to 76.2 mm) and its weight in the range 1.5 to 11 grams). Thus, the cover 10 is of such a thin thickness that it can be crushed by normal finger pressure of one hand.

These wall thicknesses are below the minimum level thicknesses that would permit distortion of the walls under minimum government mandated gas pressure in the container, e.g. 140 psig. But that need not be of concern because the cover is predistorted and everted before the container is filled, and the everted thin wall cover will not later distort or evert at or above the government minimum pressure.

A significant feature of the aerosol container cover 10 is its lack of a countersunk recess for a seaming chuck like that found in numerous conventional aerosol container covers. As previously discussed, the countersunk recess in conventional covers is typically the weakest region in the cover and is prone to evert when the aerosol container is subject to high internal pressures during manufacture, transportation or storage. Thus, the cover 10 of the present invention lacks this disadvantageous feature and is as resistant to deformation, or more resistant to deformation than conventional container covers having a thicker wall construction.

An aerosol container cover having the distinctive shape of cover 10 can be formed either prior to attachment of the cover to a container body or after its attachment to a container body as described below. The method by which cover 10 is formed and the method by which aerosol containers having a cover 10 are manufactured depends on such factors as the material from which the cover 10 is formed, the means by which the cover is attached to the container body, and if seaming is performed, the type of seaming machines used, the speed of the seaming machine and therefore the cost.

In a first method of making the cover 10 of the present invention, the cover initially has the shape of a conventional aerosol container cover having a countersunk recess for accommodating a seaming chuck. But it is made of a thin walled material as required in the cover 10 of the present invention. Such initially formed cover 60 is shown in FIG. 3, and it includes a countersunk recess 62. The recess 62 in the initially formed cover 60 is defined between opposed, radially spaced apart, outer recess wall 64 and inner recess wall 66, which are connected together by a recess floor 68. If cover 60 is made of steel, it has a wall thickness in the range of 0.005 to 0.013 inch (0.127 to 0.330 mm).

Depending on the wall thickness and the desired eversion pressure and the type of seam, the recess 62 can be made narrower, wider, shallower or deeper.

Since cover 60 includes a countersunk recess 62 to accommodate a seaming chuck, the cover 60 is attached to an aerosol container 20 by conventional seaming techniques, as shown by the seam 70 in FIG. 3.

Figure 4A:
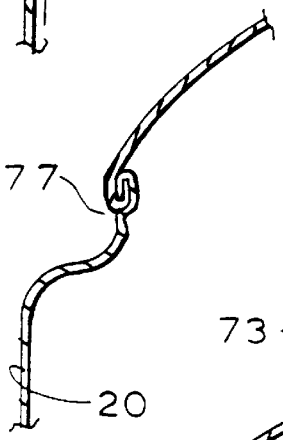
FIG. 4A is a cross-sectional partial view of an alternative modification of the container body shown in FIGS. 3 and 4.
Figure 4:
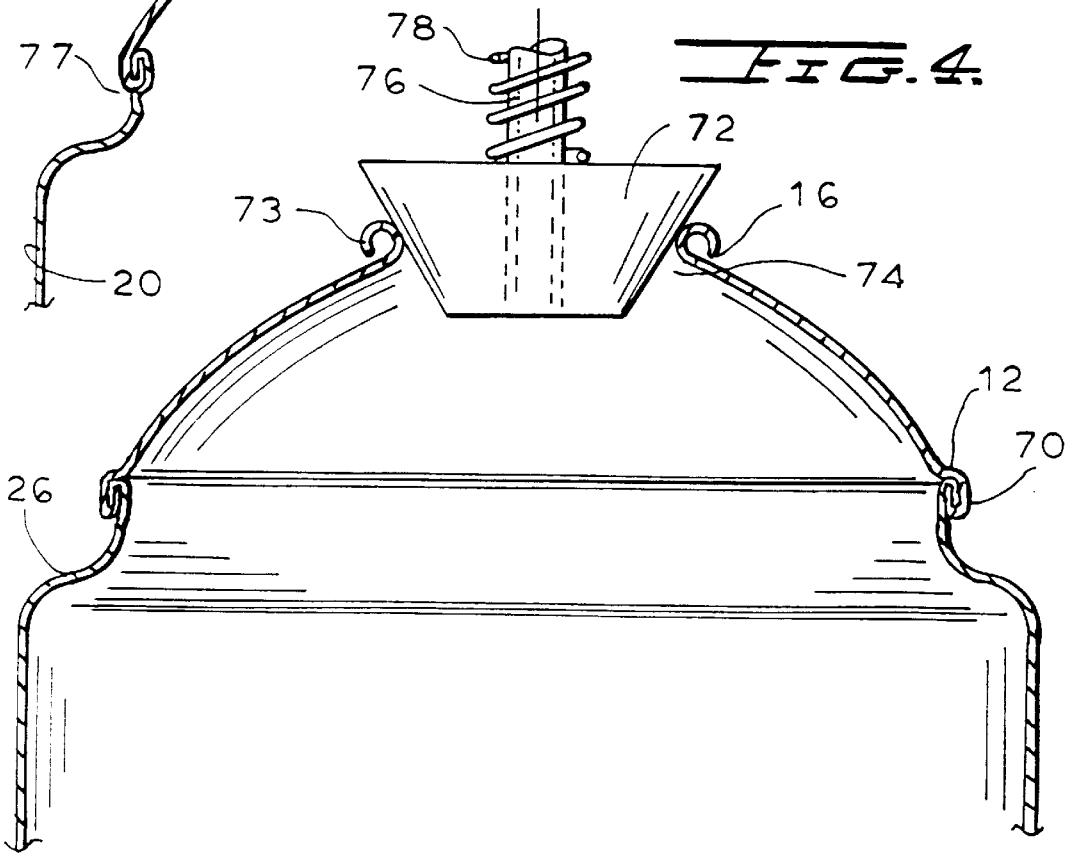

Container body 20 can be of a thin walled material, such as steel or aluminum, but can also be of a thicker walled construction such as that of conventional aerosol spray container bodies. The container body 20 is shown in FIGS. 3 and 4 as being "necked in" but could be vertical under the seam as shown in FIG. 1.

A sealing member 72, such as an elastic rubber seal, is tightly fitted into a central opening 74 of the cover 60 as shown in FIG. 3. Rubber seal 72 should have sufficient elasticity to form an airtight seal about the curl 73 at opening 74. Extending through seal 72, and perhaps extending partially into the internal area of container 20 is a tube 76 through which a pressurized fluid, such as air can flow. In addition, a tension member 78, such as a spring, is in contact with the seal 72 to retain seal 72 firmly within central opening 74 of cover 60. Although a spring is shown as the tension member 78, an air cylinder or other like device could be used.

Pressurized air flows through tube 76 and into the interior of the container formed by cover 60 and container 20, and sealed by seal 72. If cover 60 is made of steel with a wall thickness in the range of 0.005 to 0.013 inch, (0.127 to 0.330 mm), the air pressure in container 20 is increased to only approximately 50 to 150 psig (345 to 1033.5 kPa or 3.45 to 10.34 bar) which is enough to cause the thin walled cover 60 to deform upwardly compressing tension member 78, as indicated by the arrows 80 in FIG. 3, and further causes the outer recess walls 64, 66 of recess 62 to move upwardly to the point that the recess 62 is either totally or substantially eliminated as shown in FIG. 4. By subjecting cover 60 to this internal pressure, the cover 60 assumes the desired convex dome configuration of cover 10 as shown in FIG. 4, having a generally curved, convex cross-sectional or nearly hemispherical shape as it extends from outer periphery 12 to inner periphery 16. The formed cover 10 is by the physical nature of its configuration resistant to further deformation resulting from internal pressure within the container, even pressures that can rupture seams in the container. It is also resistant to downward pressure encountered in crimping and gassing.

After the cover 10 has been formed, the seal 72 is removed from central opening 74 so that container body 20 with the attached cover 10 may be filled with a fluent or viscous material and thereafter fitted with an aerosol container nozzle at the central opening 74.

If desired, the flatter part of the cover 10 at the seam 70 can be made more hemispherical in shape by the design of the recess 62, and or by increasing the eversion pressure. If this is done, it may be necessary to strengthen the double seam using a peripheral outwardly extending bead 77 in the container body 20, as shown in FIG. 4A.

Figure 5:
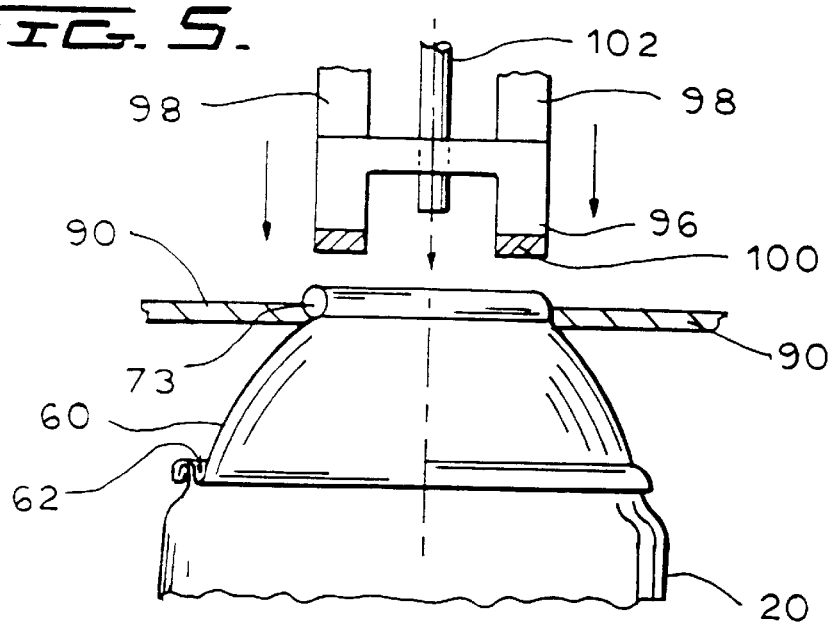
FIGS. 5 and 7 are side elevational views.
Figure 7:
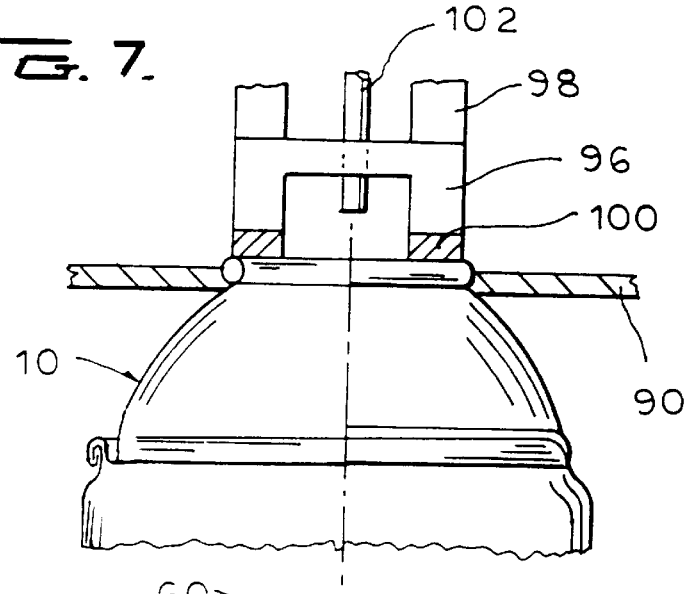
Figure 6:
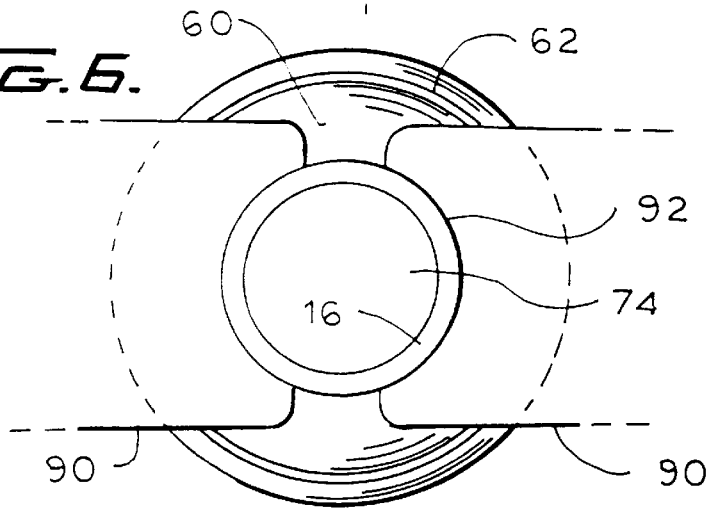
FIGS. 6 is a plan view showing a second method of forming the aerosol container cover of the present invention.
Figure 8:
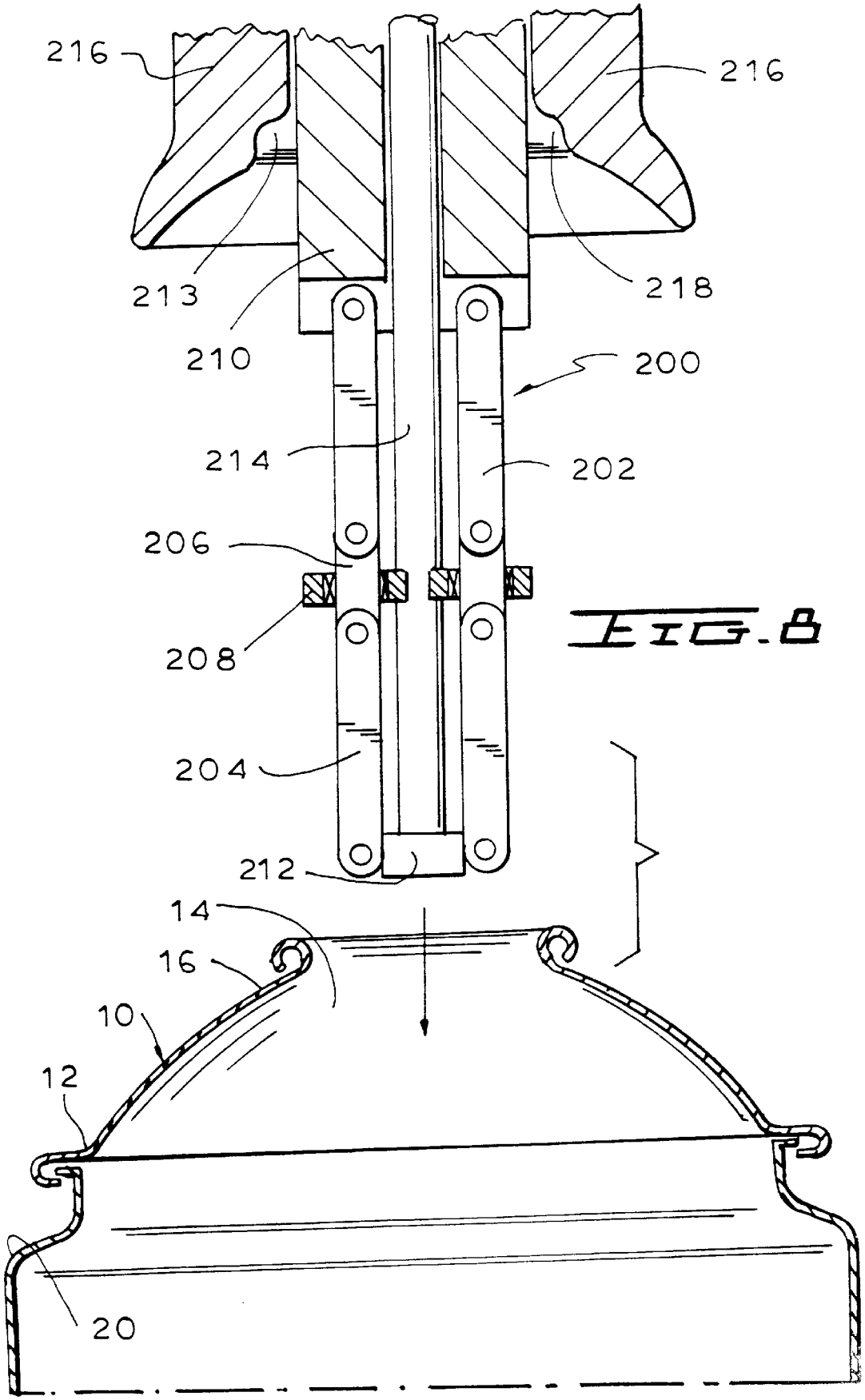
FIGS. 8, 9 and 11 are partially cross-sectional, side elevational views of a method by which the cover of the present invention, which lacks a countersunk recess, is seamed to a container body.

An alternative method of forming the cover 10 of the present invention is shown in FIGS. 5, 6 and 7. Again, a cover 60, including a countersunk recess 62 to accommodate a seaming chuck, is attached by conventional seaming processing to a container body 20. The curl 73 surrounding the central opening 74 of cover 60 is sandwiched between a two piece collar 90 and is either supported on a spring loaded base plate along with container body 20, or is suspended on the base plate. Each member of collar 90 includes a recess 92 which is curved to match the curvature of the curl 73. Although collar 90 is shown of two pieces, a one piece collar could also be used.

A generally cylindrically shaped sealing device 96 having an inverted U-shaped cross section is placed on the curl 73 at central opening 74 of cover 60. Sealing member 96 includes a resilient elastic ring 100 at its lower extremity so that an airtight and secure seal can be formed between the sealing device 96 and the curl 73 of central opening 74. A hollow tube 102 extends centrally through sealing device 96 and is connected to a source of a pressurized fluent material. Once the sealing device 96 has formed a tight seal about curl 73 of cover 60, the interior defined by container body 20 and cover 60 is pressurized by the flow of a pressurized fluent material through tube 102. The pressure to which the interior is subjected will depend on the material from which cover 60 is formed, as previously discussed. Once sufficient pressure is provided to the interior, cover 60 will evert until the recess 62 is either totally or substantially eliminated, resulting in a general transformation in the configuration of cover 60 to the point that it obtains the pressure resistance configuration of cover 10 as shown in FIG. 7.

After cover 10 is formed by this pressurization process, the airtight seal between sealing device 96 and cover 10 is broken by the upward displacement of sealing device 96. Thereafter, collar 90 places cover 10 and container body 20 onto a base plate, in the instance where they have been suspended, and thereafter releases cover 10 and container body 20 for further processing as an aerosol container.

The aerosol container cover 10 of the present invention can also be formed by conventional stamping techniques, but because it lacks a countersunk recess for a seaming chuck, conventional means for seaming the cover 10 to a container body 20 cannot be employed.

One method by which cover 10 can be seamed to container body 20 involves a four bar linkage mechanism 200, shown in FIGS. 8, 9, 10 and 11. The four bar linkage mechanism 200 includes two sets of bar linkages. Each set comprises a first linkage 202 and a second linkage 204. First and second linkages 202 and 204 are of the same length and are connected to each other by a connecting linkage 206, which supports a bearing roller 208. Each first linkage 202 is connected at an end opposite the connecting linkage 206 to a stationary shaft 210, and each second linkage 204 is connected at an end opposite connecting linkage 206 to a disk-shaped yoke 212. Two retractable shafts 214 are fixed at opposite sides of the yoke 212 and extend through openings in stationary shaft 210, and are adapted for extensible and retractable movement through the stationary shaft 210. Alternately, a thinner single central shaft could be used.

A rotating collar 216 is positioned about the outer periphery of stationary shaft 210 and is located above first linkages 202. The rotating collar 216 is, typically formed of metal, and includes a recess 218 which extends about the upper, inner periphery of rotating collar 216 and adjacent stationary shaft 210. The remaining portion of the inner periphery of rotating collar 216 is shaped to mate with the curvature of cover 10.

As shown in FIG. 11A, the rotating collar 216 may also include an insert 215 of a non-abrasive material, such as rubber or plastic. The insert 215 extends along the inner periphery of rotating collar 216, and it is insert 215 which contacts the cover 10 during the seaming process.

The four bar linkage mechanism 200, and specifically the diameter of yoke 212 and stationary shaft 210 must be dimensioned so that they can fit through the central opening 14 of cover 10.

Figure 9:
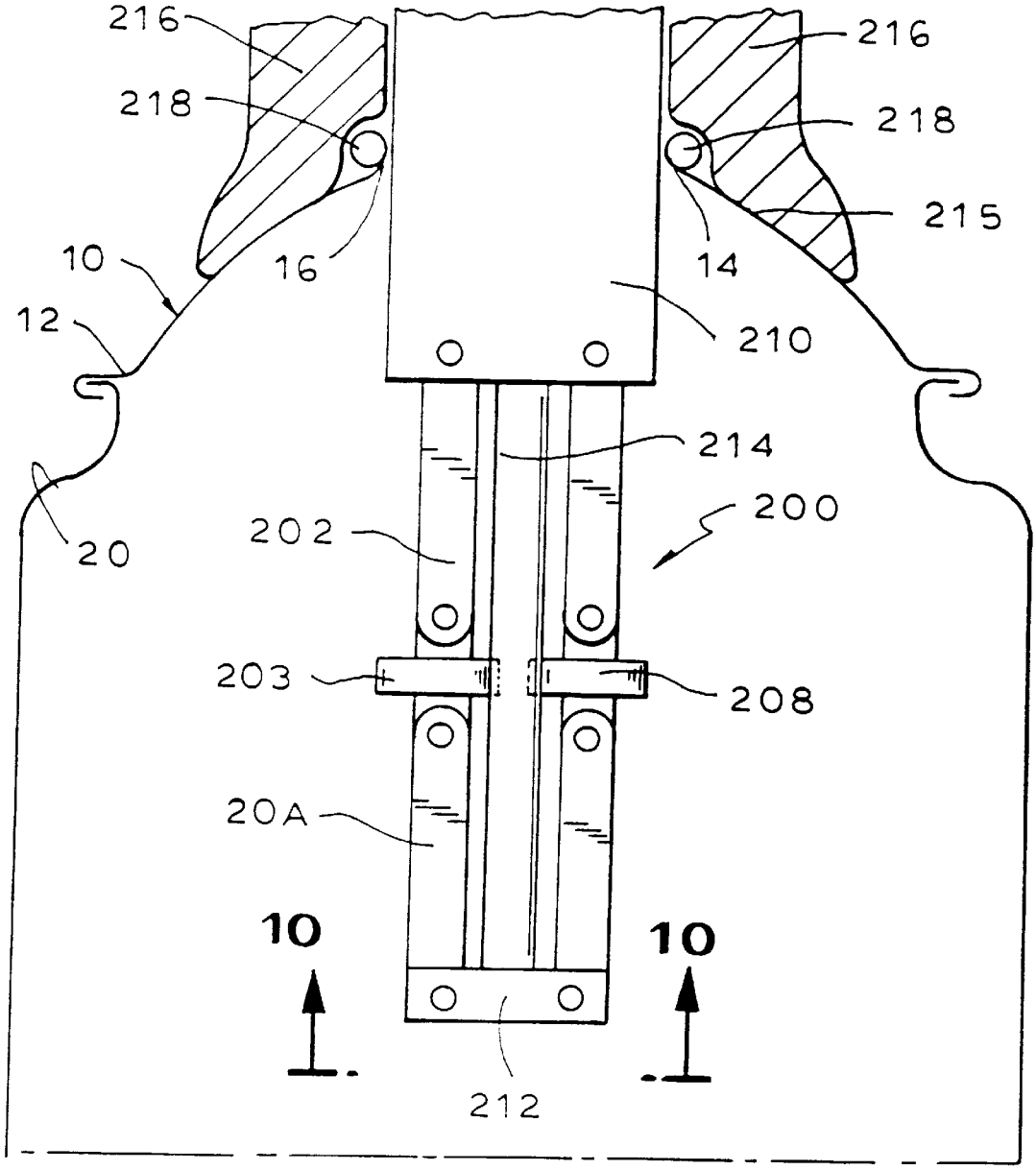
Figure 10:
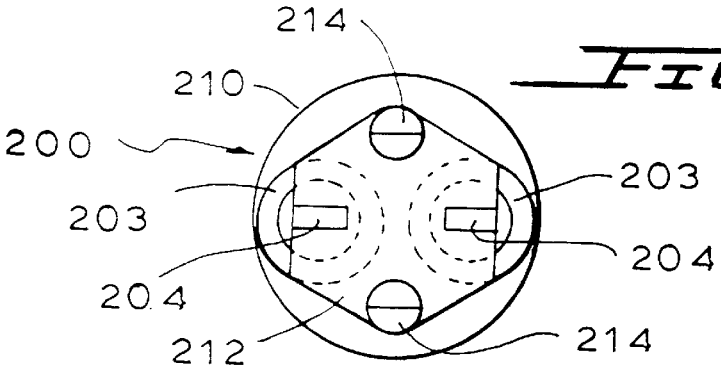
FIG. 10 is a bottom view, along the lines 10—10 of FIG. 9, of the linkage mechanism used in the seaming process shown in FIGS. 8, 9 and 11.
Figure 11:
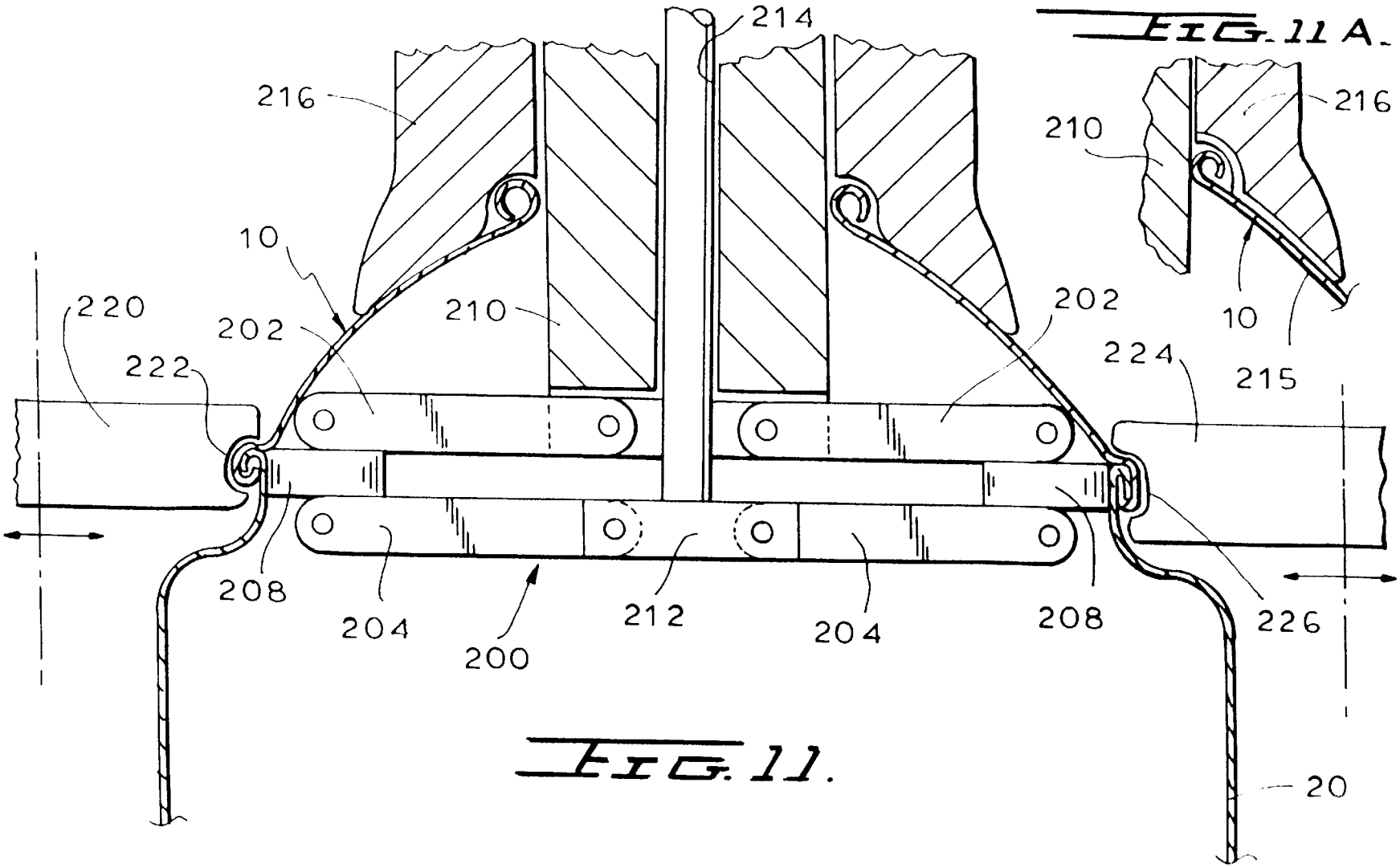

In the process of seaming cover 10 to container body 20, the cover 10 is placed at the open end of container body 20 so that the curl of the outer periphery 12 is adjacent the flange of the open end of container body 20. Referring to FIG. 9, the four bar linkage mechanism 200 is positioned through the central opening 14 of cover 10 so that the rotating collar 216 securely rests on cover 10. The retractable shafts 214 are retracted upwardly causing the four bar linkage mechanism to collapse so that first and second linkages 202, 204 are parallel to each other, which thereby positions bearing rollers 208 so they abut the inner periphery of the open end of container body 20, as shown in FIG. 11. A first seaming roller 220 having a contoured groove 222 is positioned against the curled outer edge of cover 10. Thus, the curl of cover 10 and the flange of container body 20 are sandwiched between first seaming roller 220 and one of the bearing rollers 208. By the compressive force exerted by the seaming roller 220 and opposed by a bearing roller 208, a first seaming operation is performed on the cover 10 and the container body 20, while they are rotated by collar 216. A driven rotating base plate can also be used.

After the first seaming operation is completed, the first seaming roller 220 is retracted, and a second seaming roller 224 having a contoured groove 226 which is flatter than contoured groove 222, is positioned against the first seam, and in a like manner, a second seaming operation is performed while the collar 216 rotates cover 10 and container body 20 through the compressive engagement of second seaming roller 224 and a bearing roller 208.

Once the second seaming operation is completed, the retractable shafts 214 are fully extended so that the linkage mechanism 200 resumes its original configuration. The mechanism can then be lifted out of the interior of container body 20 through the central opening 14 of cover 10. With the cover 10 of the present invention seamed to the container body 20, completion of the aerosol container may proceed, by filling the container body 20 with a fluent material and propellant and by attaching an aerosol nozzle at the central opening 14 of cover 10.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An aerosol container, comprising:

a container body having an open end with an edge defining said opening;

a seamed on top cover having an outer edge with said outer edge of said cover attached to said edge of said container body, said cover having a central opening;

aerosol dispensing means disposed at said central opening of said cover; and said cover being of a generally convex domed shape as it extends from its attachment to said container body to said central opening and being free of a countersunk recess in the vicinity of its attachment to said container body.

2. The aerosol spray container of claim 1, wherein said cover is of steel and has a wall thickness in the range of 0.005 to 0.013 inch (0.127 to 0.330 mm).

3. The aerosol spray container of claim 1, wherein said cover is of aluminum and has a wall thickness in the range of 0.005 to 0.018 inch (0.127 to 0.457 mm).

* * * * *

UNITED STATES PATENT AND TRADEMARK OFFICE

CERTIFICATE OF CORRECTION

PATENT NO. : 5,865,337
DATED : February 2, 1999
INVENTOR(S) : George B. Diamond et al.

It is certified that error appears in the above-identified patent and that said Letters Patent is hereby corrected as shown below:

Column 4, line 48, after "110 psig" insert --,--.

Signed and Sealed this

Twenty-fourth Day of August, 1999

*Attest:*

Q. TODD DICKINSON

*Attesting Officer*

*Acting Commissioner of Patents and Trademarks*